US008279118B2

(12) United States Patent
Snow

(10) Patent No.: US 8,279,118 B2
(45) Date of Patent: Oct. 2, 2012

(54) APERIODIC ANTENNA ARRAY

(75) Inventor: Jeffrey M. Snow, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 194 days.

(21) Appl. No.: 12/571,175

(22) Filed: Sep. 30, 2009

(65) Prior Publication Data

US 2011/0074630 A1 Mar. 31, 2011

(51) Int. Cl.
*H01Q 3/00* (2006.01)

(52) U.S. Cl. ..... 342/372; 342/373

(58) Field of Classification Search ..... 342/368, 342/373, 372

See application file for complete search history.

(56) References Cited

U.S. PATENT DOCUMENTS

| | | | | |
|---|---|---|---|---|
| 3,182,330 | A | 5/1965 | Blume | |
| 3,393,400 | A * | 7/1968 | Trott | 367/13 |
| 3,460,150 | A * | 8/1969 | Mei | 342/375 |
| 3,978,482 | A | 8/1976 | Williams et al. | |
| 4,001,691 | A * | 1/1977 | Gruenberg | 375/214 |
| 4,071,848 | A | 1/1978 | Leeper | |
| 4,485,484 | A * | 11/1984 | Flanagan | 381/92 |
| 4,797,682 | A | 1/1989 | Klimczak | |
| 5,079,557 | A | 1/1992 | Hopwood et al. | |
| 5,093,668 | A | 3/1992 | Sreenivas | |
| 5,231,406 | A | 7/1993 | Sreenivas | |
| 5,262,790 | A | 11/1993 | Russo | |
| 5,367,313 | A | 11/1994 | Orime et al. | |
| 5,905,462 | A | 5/1999 | Hampel et al. | |
| 6,128,958 | A * | 10/2000 | Cain | 367/138 |
| 6,147,657 | A | 11/2000 | Hildebrand et al. | |
| 6,336,033 | B1 | 1/2002 | Yamaguchi et al. | |
| 6,392,611 | B1 | 5/2002 | Smith et al. | |
| 6,456,244 | B1 | 9/2002 | Goldstein et al. | |
| 6,525,697 | B1 | 2/2003 | Theobold | |
| 6,784,838 | B2 | 8/2004 | Howell | |
| 6,842,157 | B2 | 1/2005 | Phelan et al. | |
| 6,870,517 | B1 | 3/2005 | Anderson | |
| 6,888,504 | B2 | 5/2005 | Chiang et al. | |
| 6,897,829 | B2 | 5/2005 | Oliver et al. | |
| 6,970,133 | B2 | 11/2005 | Chandler | |
| 7,057,559 | B2 | 6/2006 | Werner et al. | |
| 7,348,929 | B2 | 3/2008 | Phelan et al. | |
| 2002/0021246 | A1 * | 2/2002 | Martek et al. | 342/373 |
| 2003/0220554 | A1 * | 11/2003 | Grenon et al. | 600/407 |
| 2005/0088358 | A1 | 4/2005 | Larry | |

(Continued)

*Primary Examiner* — Jack W Keith
*Assistant Examiner* — Fred H Mull
(74) *Attorney, Agent, or Firm* — Christopher A. Monsey

(57) ABSTRACT

An exemplary aperiodic antenna array comprises a plurality of first elements radiating electromagnetic energy over a first bandwidth including a first frequency. Each of the first elements is spaced apart from a pattern center by an element distance and from the nearest first element by an element spacing in a regulated pattern. In the regulated pattern, the element spacing increases as the element distance increases. The plurality of first elements are configured to generate a first radiation pattern. The antenna array also comprises a second element positioned within a group of first elements from the plurality of first elements. Each element distance between the first elements in the group of first elements is greater than one-half of a first wavelength corresponding to the first frequency. The second element is configured to generate a second radiation pattern. The second radiation pattern combines with the first radiation pattern to form a composite radiation pattern.

10 Claims, 11 Drawing Sheets

U.S. PATENT DOCUMENTS

2007/0152893 A1 7/2007 Chiang et al.
2007/0210956 A1 9/2007 Hillis et al.
2008/0094301 A1 4/2008 Lee et al.
2010/0117905 A1* 5/2010 Barnard et al. ..... 342/381

* cited by examiner

APERIODIC ANTENNA ARRAY

STATEMENT REGARDING FEDERALLY SPONSORED RESEARCH OR DEVELOPMENT

The invention described herein was made in the performance of official duties by an employee of the Department of the Navy and may be manufactured, used, licensed by or for the United States Government for any governmental purpose without payment of any royalties thereon.

FIELD OF THE INVENTION

The invention relates generally to antenna arrays. In particular, the invention relates to antenna arrays wherein radiating elements are disposed in aperiodic patterns.

BACKGROUND

An antenna array comprises a multitude of elements coupled to produce a directive radiation pattern which is the composite of the patterns radiated by each element. The spatial relationship of the elements contributes to the directivity of the antenna. A beam former may use variable phase or time-delay control at each radiating element to create a pattern of constructive and destructive interference in the wave front to achieve a desired radiation pattern.

Phase control is used to steer a main beam. The antenna array size may be increased to narrow the main lobe of the radiation pattern. Side lobes of various sizes may develop. As the number of elements in the array increases, the sizes of the side lobes may reduce. Combined amplitude tapering and phase controls may be used to adjust side lobe levels and steer nulls better than can be achieved by phase control alone. Feed networks and element-level electronics such as filters and amplifiers are generally included to enable the beam former to steer the main beam. The nulls between side lobes occur when the radiation patterns pass through the origin in the complex plane. Thus, adjacent side lobes are generally 180 degrees out of face to each other. Grating lobes may be formed depending on the main beam steering angle and the spacing of the elements.

Antenna arrays may suffer from bandwidth limitations and mutual coupling between closely-spaced elements. Another disadvantage is that closely-spaced elements may lack sufficient spacing for the insertion of electronic components associated with the element feed network and element modules (element-level electronics). Improvements are needed to reduce the effect of grating lobes to increase gain and directivity of the antenna arrays.

SUMMARY

A method for designing and operating antenna arrays, and antenna arrays resulting therefrom, are disclosed herein. In one embodiment, an antenna array comprises a plurality of first elements radiating electromagnetic energy over a first bandwidth including a first frequency. Each of the first elements is spaced apart from a pattern center by an element distance and from the nearest first element by an element spacing in a regulated pattern. In the regulated pattern, the element spacing increases as the element distance increases. The plurality of first elements are configured to generate a first radiation pattern based partially on the regulated pattern and the first frequency. The antenna array also comprises a second element positioned within a group of first elements from the plurality of first elements. Each element distance between the first elements in the group of first elements is greater than one-half of a first wavelength corresponding to the first frequency. The second element is configured to generate a second radiation pattern. The second radiation pattern combines with the first radiation pattern to form a composite radiation pattern.

BRIEF DESCRIPTION OF THE DRAWINGS

The above-mentioned and other disclosed features, and the manner of attaining them, will become more apparent and will be better understood by reference to the following description of disclosed embodiments taken in conjunction with the accompanying drawings, wherein.

DETAILED DESCRIPTION

Figure 1:
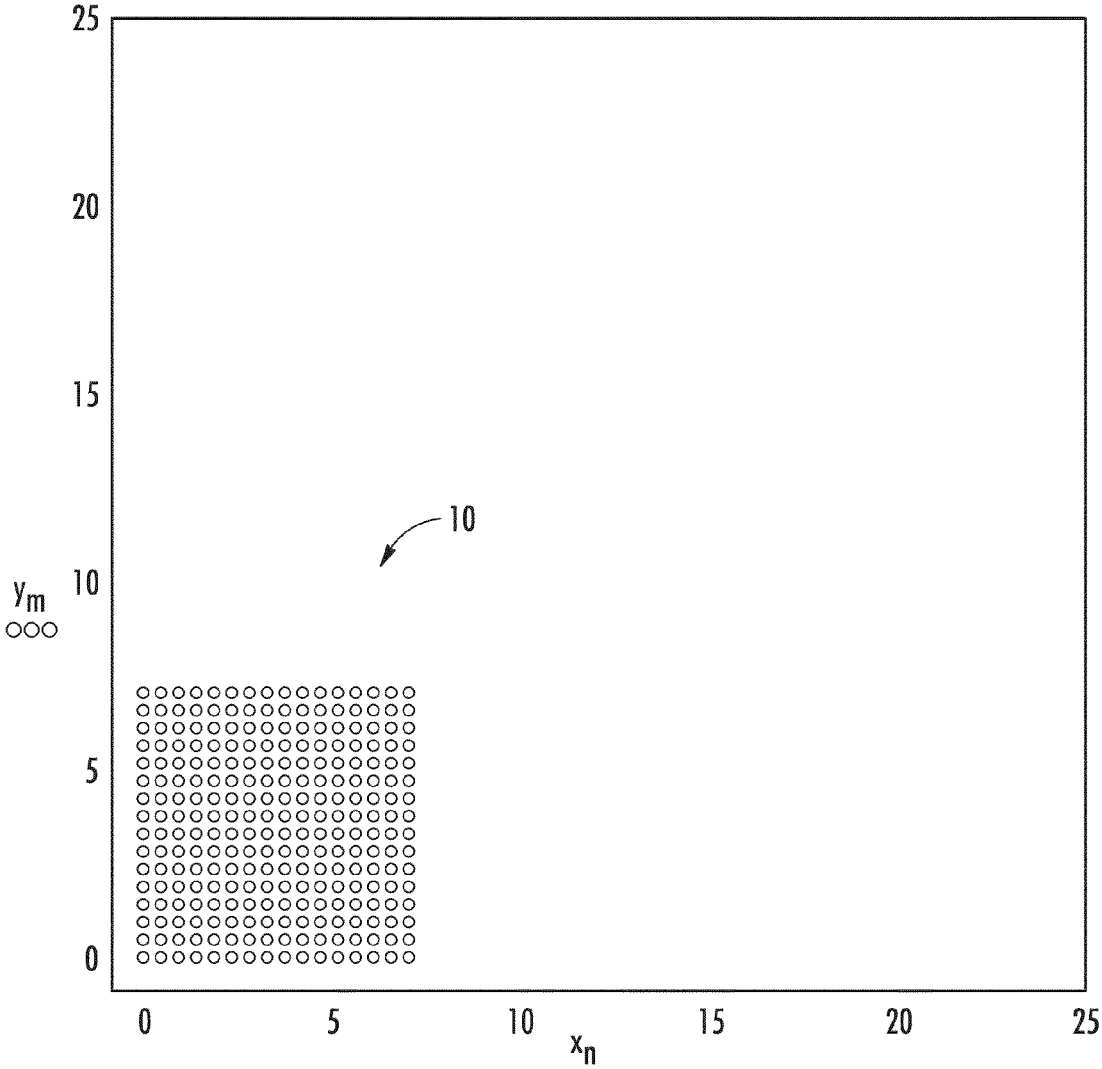
FIG. 1 is a graph of a periodic antenna array pattern with element spacing smaller than $\lambda/2$.

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Embodiments according to the invention of a method for designing and operating antenna arrays, and antenna arrays resulting therefrom, are disclosed herein. In one embodiment, one or two dimensional aperiodic antenna arrays are provided wherein the spacing between radiating elements vary depending on the position of each array element in relation to the center of the array. By "aperiodic" it is meant that the element spacings are not uniform although the non-uniformity may be regulated. In other words, the variations in element spacing may be determined according to a regulated pattern. The regulated pattern is illustrated herein with reference to a pattern center, element distance and element spacing. The pattern center is an illustrative point of reference and may be chosen in any known manner. The pattern center may coincide with the center of the array although it does not have to. Element distance is the distance between an element and the pattern center. Element spacing is the distance between one element and another element, where the other element is the element nearest the one element. Element spacing may increase in a linear, logarithmic, or any other relationship.

In one embodiment of an array comprising a first pattern of first elements, the pattern center is defined based on the closest element spacing, and element spacing increases in relation to the element distance. Thus, element spacing varies. The first elements may be controlled to transmit or reflect energy in a first radiation pattern. The first elements comprise elements which effectively radiate at a particular frequency and bandwidth. For example, the first elements may radiate effectively within a 10% band, e.g. 10.0+/−0.5 Ghz frequency. In the present embodiment, elements located further away from the pattern center have greater element spacings and elements located closer to the pattern center have smaller element spacings. The first pattern may be regulated in any known manner. Elements may be arranged in rows and columns in a planar array. Aperiodicity may be provided by spreading the rows, or the columns, or both. Thus, in another embodiment the first element spacings increase relative to element distance in one axis but not the other, or increase in one axis more than in the other. In an alternative embodiment, the first elements are disposed in a growing Archimedean spiral. In a further embodiment, the first elements are disposed in concentric circles of increasing diameter. Furthermore, in an additional embodiment the first elements are disposed in a conformal array where the elements are attached to a substrate which conforms to the shape of a supporting structure, e.g., a fuselage, turret, and the like.

Grating lobes are undesired sidelobes that are of the same magnitude as the main beam. Grating lobes are not generated when:

$$d/\lambda<1/(1+\sin\theta)$$

Where d is the spacing between elements, λ is the wavelength and θ is the angle from normal or perpendicular to the array. So at the greatest possible steering angle, 90 degrees, $d/\lambda=1/2$ and with the main beam at the least steering angle, normal to the array, $d/\lambda=1$. Element spacing greater than half the wavelength may cause grating lobes depending on the main beam steering angle, and element spacing greater than a wavelength will generally generate grating lobes.

Advantageously, the aperiodic patterns reduce the intensity of grating lobes and enable array modifications which further improve directivity and reduce grating lobes. One modification entails the addition of second elements such as steering elements and wideband elements. Whereas the first elements generate a first radiation pattern, the second elements generate a second radiation pattern, and the first and second radiation patterns produce a composite radiation pattern for the hybrid array which results from the radiation of the first and second patterns and the constructive and destructive interference between them. Increases in element spacing enable addition of wideband elements and steering elements with associated control circuitry.

In one embodiment, the second elements comprise wideband elements. In a preferred embodiment, a wideband element radiates within +/−10% of a selected frequency without substantial losses where a first element transmitting at the same frequency radiates inefficiently if the frequency changes by more than +/−5%. In a more preferred embodiment, the wideband element radiates in a +/−15% range without substantial losses. The combination of a majority of elements having a particular bandwidth with a minority of elements having wider bandwidths may enable generation of improved radiation patterns. Furthermore, the second elements may enable generation of the composite radiation pattern over a wider range of frequencies as compared to the range of frequencies over which the first radiation may be produced. As the driving frequency is lowered below the low end of the range of frequencies operable with the first elements, the efficiency of the first elements rapidly decays. However, the efficiency of the wideband elements, or second elements, does not decay since their frequency range is wider. Thus, the ratio of the directivity of the second radiation pattern to the first radiation pattern increases as the efficiency of the first elements decays, thereby increasing the effect of the second radiation pattern on the composite radiation pattern.

Figure 7:
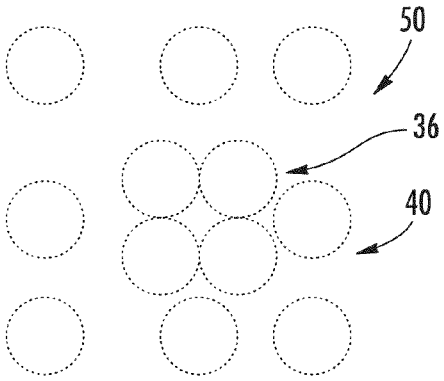

In another embodiment, the second elements comprise steering elements. Steering elements comprise two or more commonly driven sub-elements which are disposed within a group of first elements. As described with reference to FIGS. 15-17, an amplifier may drive the steering element and element circuits introduce phase-shifts or time-delays to the driving signal from the amplifier to generate a second radiation pattern. Multiple steering elements may be provided to produce a stronger second radiation pattern and an even more improved composite pattern. In a preferred embodiment, the group of first elements within which the steering element is placed comprises at least eight elements and is characterized by element spacings greater than ½λ. A ninth element may be disposed within the group and the steering element as shown with reference to element 42 in FIG. 8, although as shown in FIG. 7, the ninth element may also be absent from the first pattern. In further embodiments of the invention, first and second elements may be combined in different ways based upon the first pattern, element spacings and array frequency. The radiating elements of the steering element are referred to as sub-elements or third elements and may comprise base elements, wideband elements, or other elements.

In a further embodiment, an antenna array comprises a first plurality of first elements and a second plurality of first elements. The first and second pluralities of first elements are arranged in the regulated pattern described hereinabove. The first plurality of first elements is driven to generate a first radiation pattern. The second plurality of first elements is commonly driven similarly to steering elements to generate a second radiation pattern. A third, fourth and fifth plurality of first elements may be driven like steering elements in combination with the second plurality of first elements to form the second radiation pattern. In a preferred embodiment, the second, third, fourth and fifth plurality of first elements form first, second, third and fourth steering elements which are distributed evenly around the pattern center.

Figure 2:
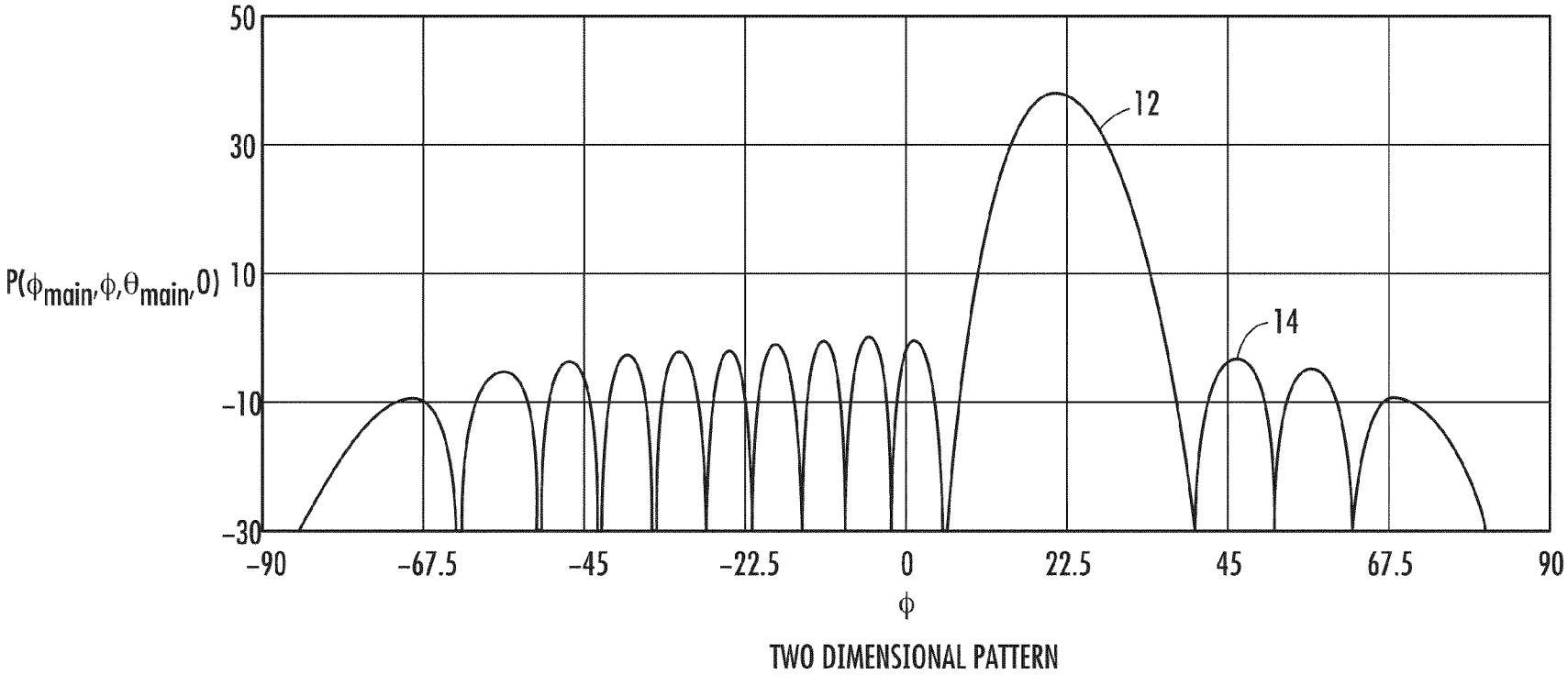
FIG. 2 is a graph illustrating a pattern obtained by simulating transmission from a two-dimensional antenna array having elements disposed in the pattern shown in FIG. 1.

Periodic and aperiodic patterns will now be described conceptually with reference to FIGS. 1 to 11. FIG. 1 is a graph of a periodic antenna array pattern with element spacing smaller than λ/2 and FIG. 2 is a graph illustrating a radiation pattern obtained by simulating transmission from a two-dimensional antenna array having elements disposed in the pattern shown in FIG. 1. The periodic element pattern, denoted by numeral 10, illustrates a 16×16 element array. The horizontal and vertical axes represent a number of wavelengths. As illustrated, sixteen elements are located in a spacing of approximately seven wavelengths resulting in an element spacing of about 7/15λ which is less than a half wavelength (½λ). The radiation pattern shows main lobe 12 resulting from steering the main beam to 22 degrees and a plurality of side lobes 14.

Figure 3:
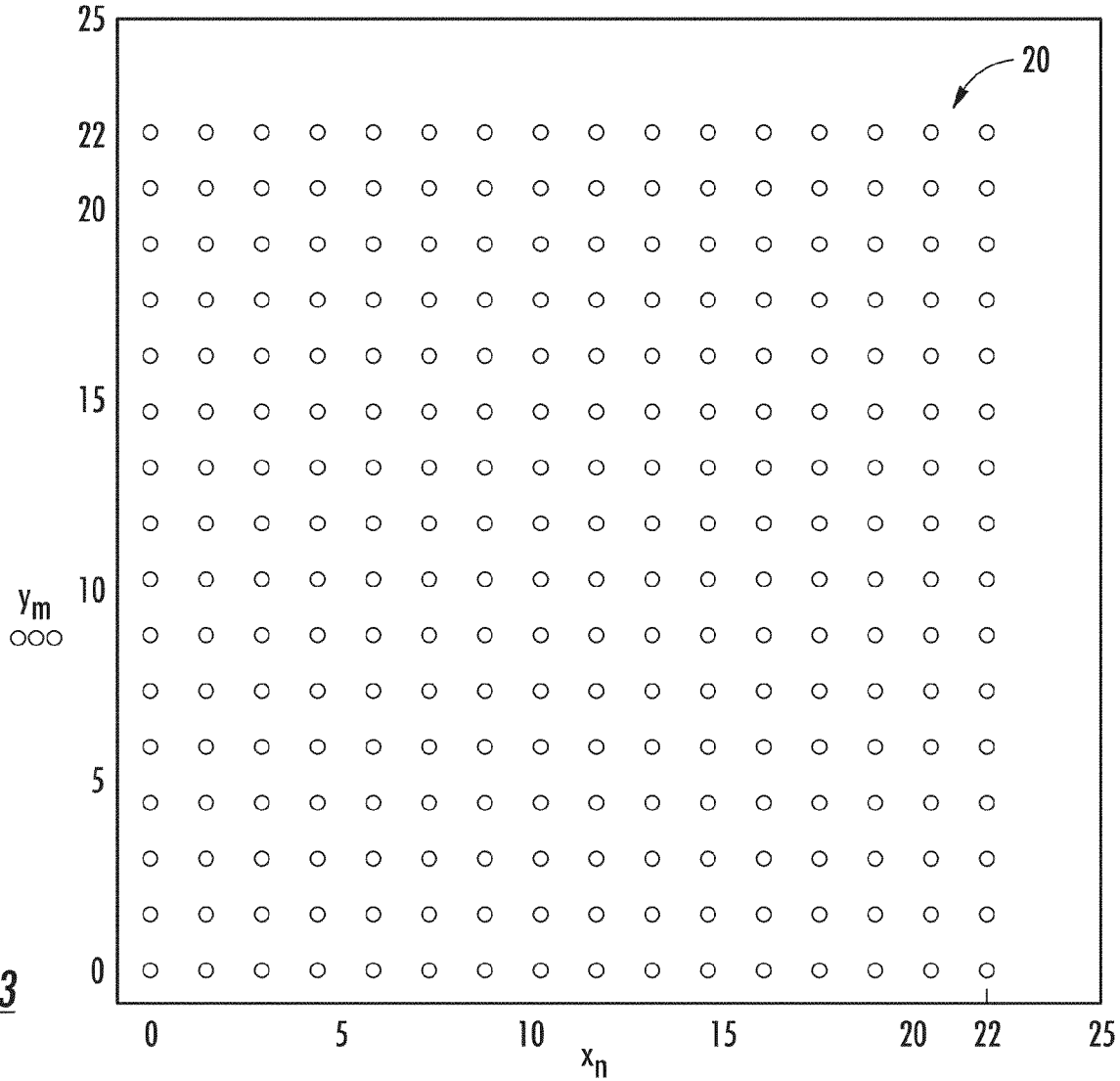
FIG. 3 is a graph of a periodic antenna array pattern with element spacing larger than $\lambda/2$.
Figure 4:
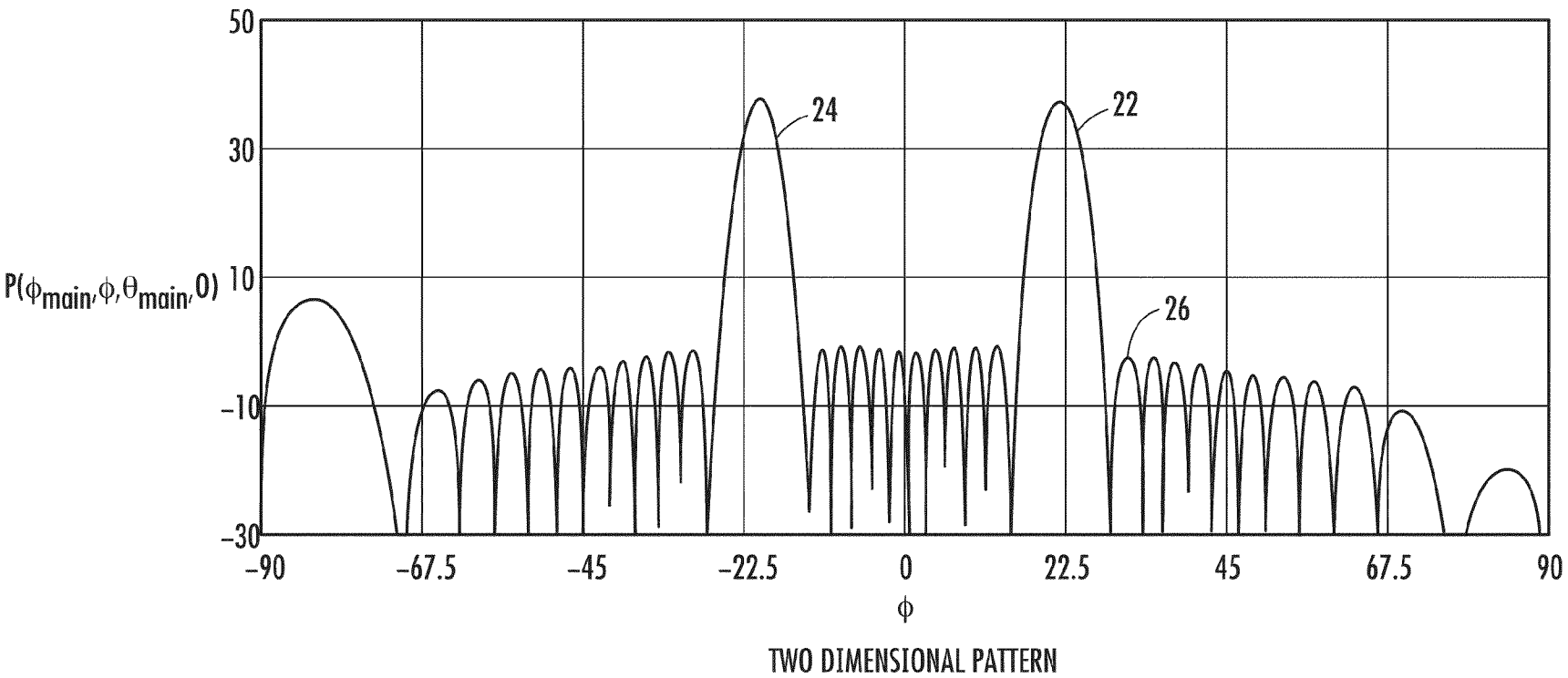
FIG. 4 is a graph illustrating a pattern obtained by simulating transmission from a two-dimensional antenna array having elements disposed in the pattern shown in FIG. 3.

FIG. 3 is a graph of a periodic antenna array pattern with element spacing greater than $\lambda/2$ and FIG. 4 is a graph illustrating a radiation pattern obtained by simulating transmission from a two-dimensional antenna array having elements disposed in the pattern shown in FIG. 3. The periodic element pattern, denoted by numeral 20, illustrates a 16×16 element array. As illustrated, sixteen elements are located in a spacing of approximately twenty-two wavelengths resulting in an element spacing of about $22/15\lambda$ which is greater than a wavelength ($1\lambda$). The radiation pattern includes main lobe 22 and grating lobe 24 as well as a plurality of side lobes 26 located right and left of main lobe 22. Main lobe 22 results from steering the main beam to 22 degrees from boresight. Grating lobe 24 results from the uniform expansion of element spacings.

Figure 5:
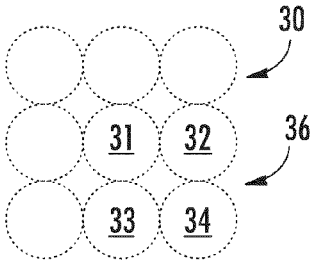
FIG. 5 is a conceptual diagram illustrating a periodic antenna array pattern.
Figure 6:
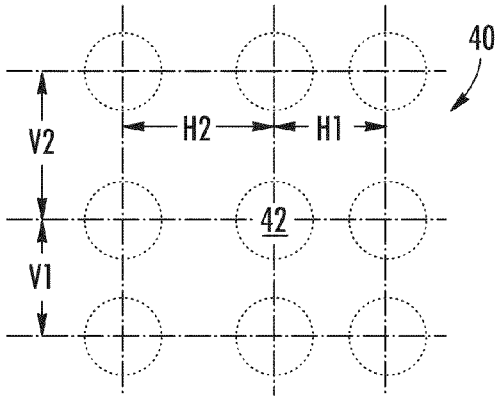
FIGS. 6 to 11 are conceptual diagrams illustrating antenna array patterns according to various embodiments of the invention.
Figure 8:
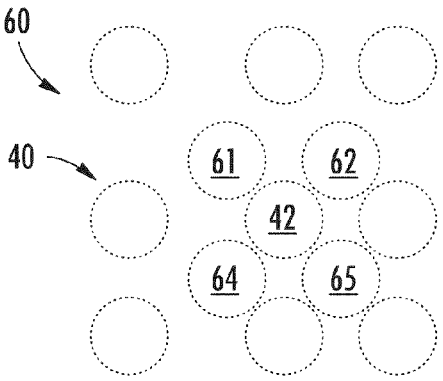
Figure 9:
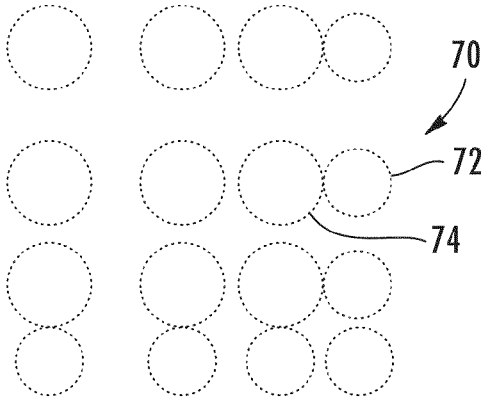

FIG. 5 is a graph of a portion of a periodic antenna array pattern. The portion, denoted by numeral 30, comprises nine equally spaced elements. A dashed circle denotes the position of an element and its bandwidth. The position is at the center of the dashed circle, and the diameter of the circle represents the size of the radiating pattern of the element which is proportional to the largest wavelength or lowest frequency. Portion 30 represents nine elements positioned in close proximity. Sub-elements 31, 32, 33 and 34 form pattern 36. In contrast, aperiodic pattern 40, shown in FIG. 6, illustrates the position of nine elements located northwest of the pattern center as evidenced by the increased element spacing V2 compared to V1 and element spacing H2 compared to H1. Stated differently, element spacing above and left of element 42 is greater than element spacing right and below element 42. FIG. 7 shows pattern 50 which is a modified pattern 40. Four sub-elements were added and arranged in pattern 36 such that the center of pattern 36 overlaps the position of element 42, which has been removed. In one embodiment, the four sub-elements of pattern 36 comprise a steering element. The other elements, those which comprise the majority of elements in the array, will be referred to as the first, or base, elements. FIG. 8 shows pattern 60 which is a modified pattern 40. Sub-elements 61, 62, 64 and 65, comprising a steering element, were added. Element 42 may be included with the steering element or may be controlled with the base elements. FIG. 9 shows pattern 70 comprising seven base elements 72 and nine elements 74 having a bandwidth larger than the bandwidth of the base elements. As with steering elements, the aperiodic pattern enables the replacement of base elements 72 with elements 74.

Figure 10:
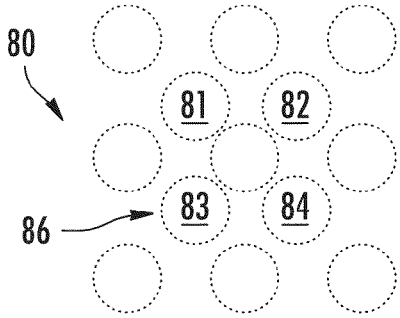
Figure 11:
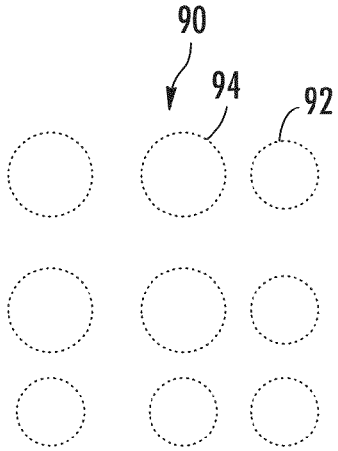

As shown in FIGS. 10 and 11, hybrid patterns may also be formed to improve uniform array patterns. FIG. 10 is a graph of periodic antenna array patterns 80 and 86. Pattern 80 comprises nine equally spaced base elements and pattern 86 comprises a steering element formed with sub-elements 81, 82, 83 and 84. FIG. 11 is a graph of periodic antenna array pattern 90. Pattern 90 comprises nine equally spaced elements wherein four elements 94 are wideband elements and five elements 92 are base elements. Obviously, the patterns illustrate relationships between first and second elements and are not intended to limit the invention to the precise number of elements described herein.

Figure 12:
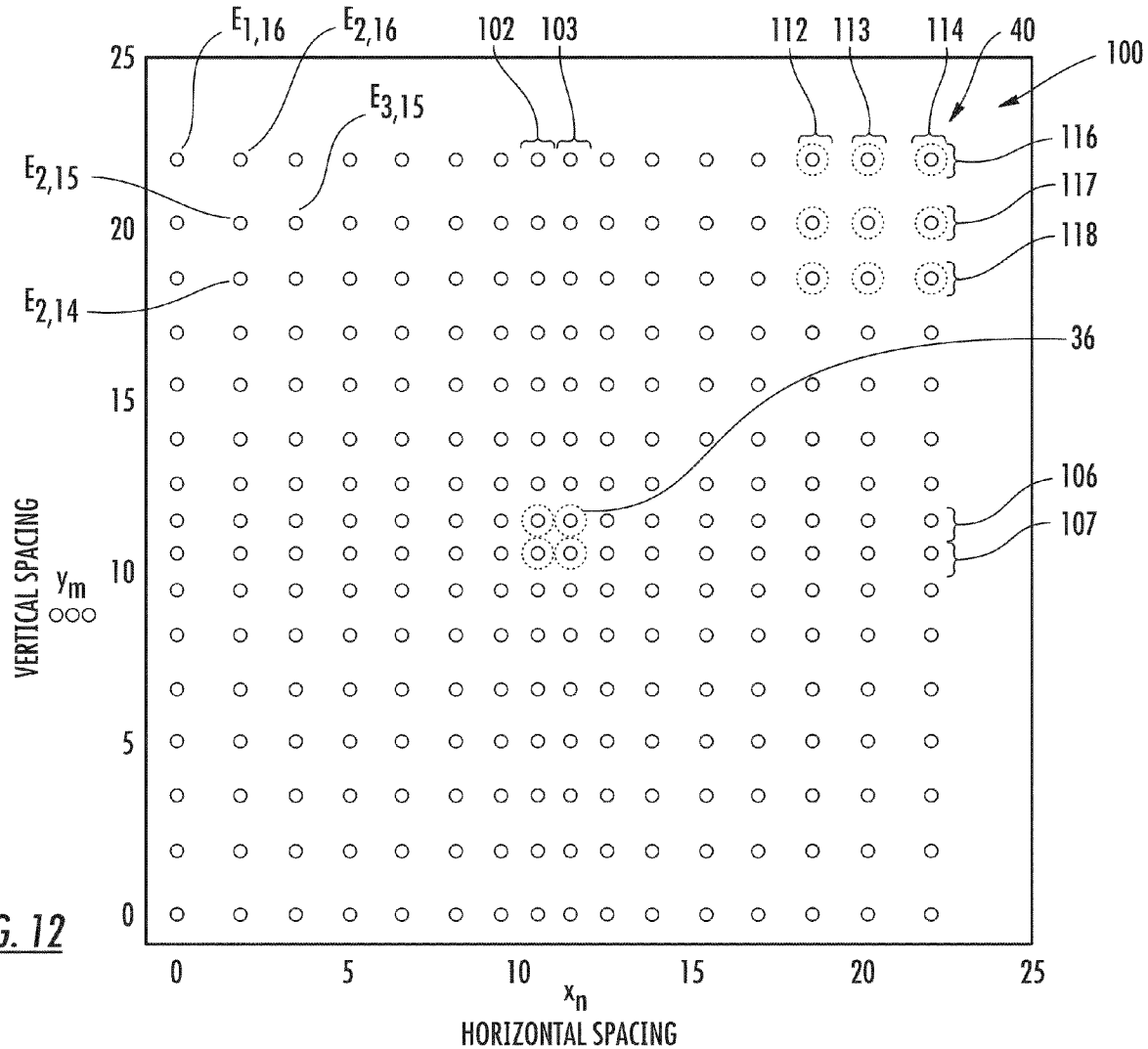
FIG. 12 is a graph illustrating an embodiment of an aperiodic antenna array pattern.
Figure 13:
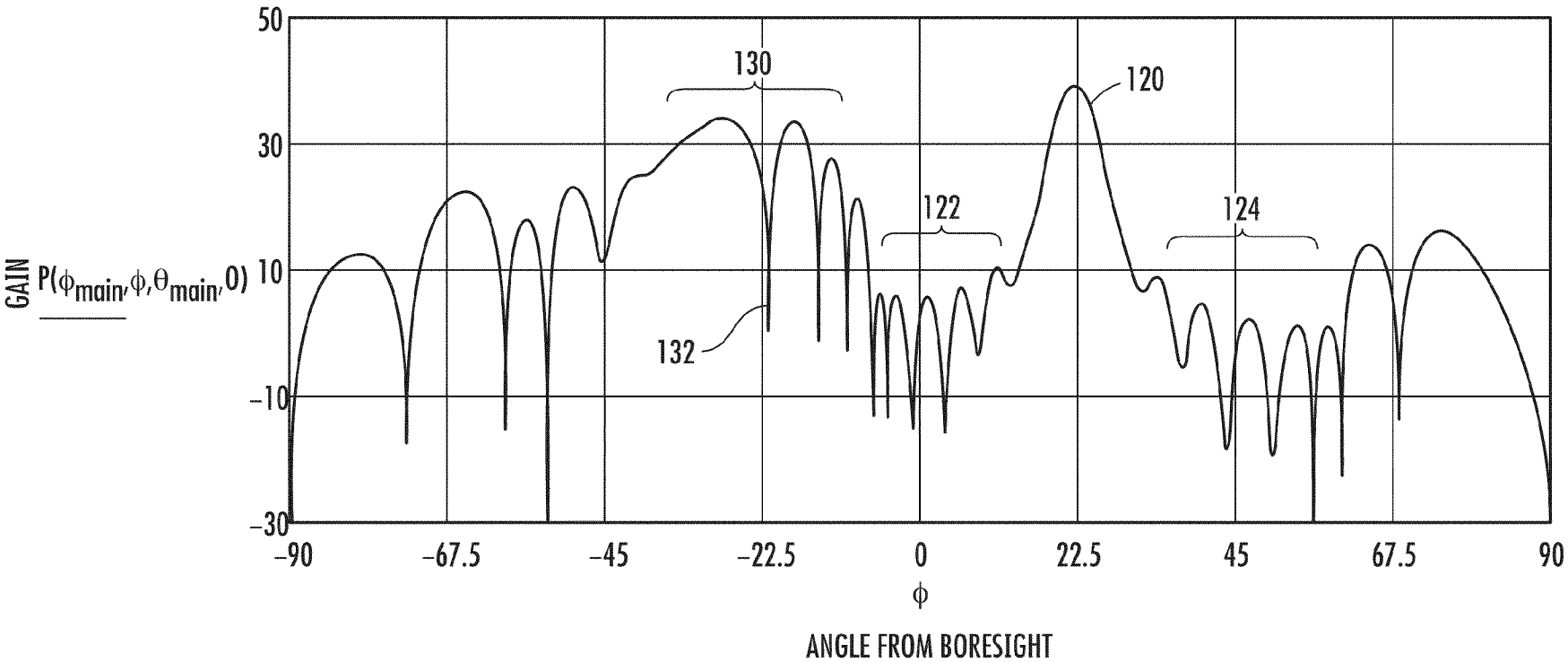
FIG. 13 is a graph illustrating a pattern obtained by simulating transmission from a two-dimensional antenna array having elements disposed in the pattern shown in FIG. 12.

Having described various embodiments of the invention comprising periodic and aperiodic patterns and modifications thereto, further embodiments of the invention will now be described with reference to FIGS. 12 to 17. FIG. 12 is a graph of first pattern 100 including base elements, represented by solid-line circles, at the intersections of sixteen rows and sixteen columns. A group of four elements in pattern 36 is shown at the intersection of columns 102, 103 and rows 106, 107. A pattern 40 of base elements is shown at the intersections of columns 112, 113, 114 and rows 116, 117, 118. Specific elements are pointed out with reference to their coordinates (column, row) including elements $E_{1,16}$, $E_{2,16}$, $E_{2,15}$, $E_{3,15}$ and $E_{2,14}$. FIG. 13 is a graph illustrating a first radiation pattern obtained by simulating transmission from a two-dimensional antenna array having elements disposed in first pattern 100. The first radiation pattern shows main lobe 120, a plurality of side lobes 122 and 124, null 132 at negative 22 degrees from boresight, and sidelobes 130 on either side of null 132. The grating lobe previously located at negative 22 degrees has been attenuated as a result of the aperiodicity of the first pattern 100.

Figure 14:
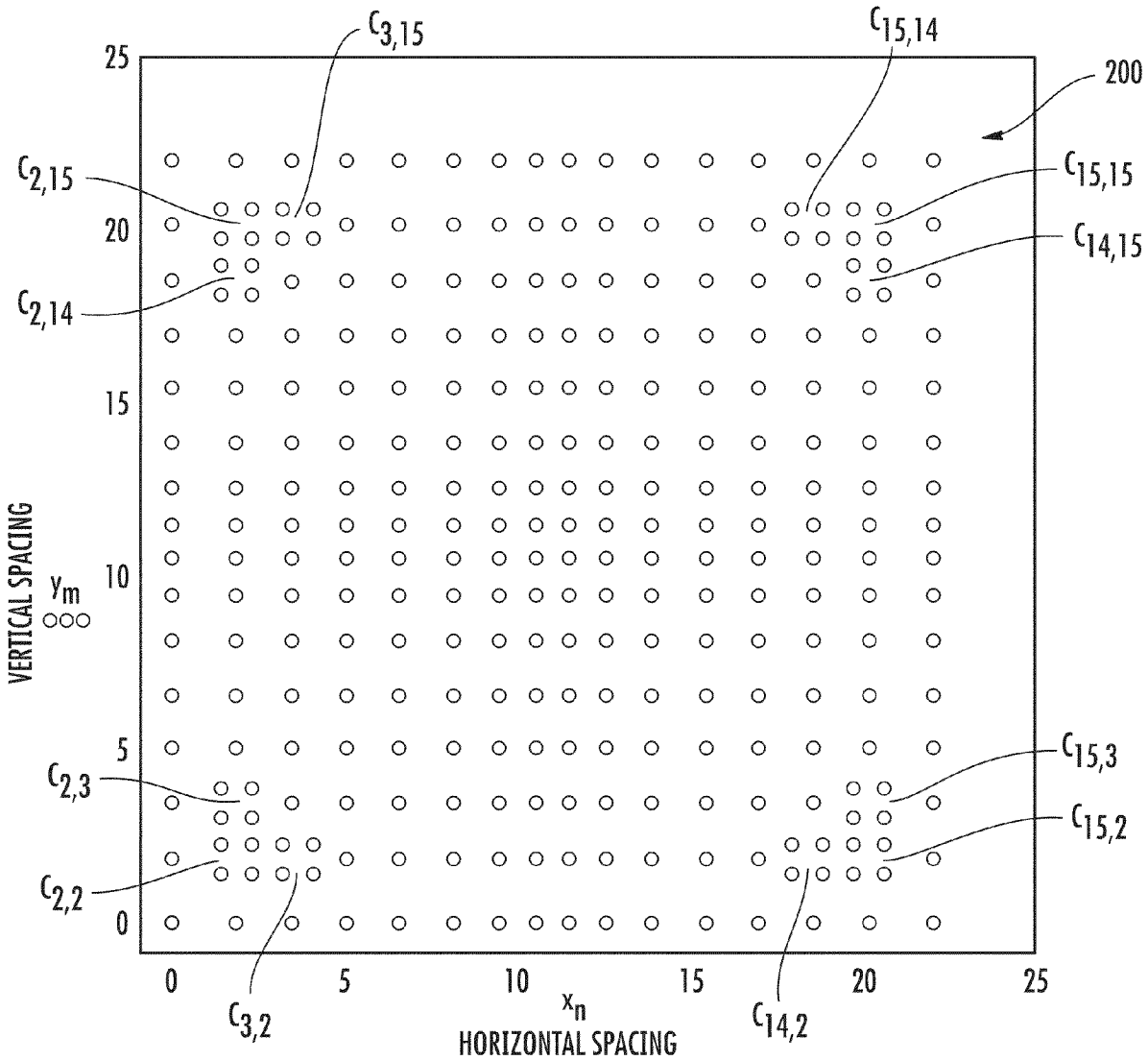
FIG. 14 is a graph illustrating an aperiodic antenna array pattern according to another embodiment of the invention.

FIG. 14 illustrates another embodiment according to the invention wherein a number of base elements in first pattern 100 were replaced with steering elements to form aperiodic array pattern 200. Groups of four elements comprise steering elements located at $C_{2,2}$, $C_{2,3}$, $C_{3,2}$, $C_{14,2}$, $C_{15,2}$, $C_{15,3}$, $C_{2,14}$, $C_{2,15}$, $C_{3,15}$, $C_{15,14}$, $C_{15,15}$ and $C_{14,15}$. The letter C indicates a composite element, e.g., a steering element. Each of these steering elements may be controlled independently or combined with other steering elements to produce a signal which reduces the amplitude of any particular side lobe to thereby increase the directivity of the pattern. In another embodiment, wide bandwidth elements, denoted by the letter W, may replace base elements, for example at $W_{2,2}$, $W_{2,3}$, $W_{3,2}$, $W_{14,2}$, $W_{15,2}$, $W_{15,3}$, $W_{2,14}$, $W_{2,15}$, $W_{3,15}$, $W_{15,14}$, $W_{15,15}$ and $W_{14,15}$. The pattern center is located between rows 8-9 and columns 8-9 which is where the element spacing is at a minimum. Elements in the steering elements may be the same as the first elements or may be different.

Digital beam forming techniques can be used to overcome the deficiencies of the higher side lobes. For example, amplitude tapering or weighting, typical on uniform spaced arrays, may be applied to further distinguish the main lobe from side lobes. By comparing signal strength versus beam position a computer can determine where the target, or signal emitter, as the case might be, is located. Increased spacing between elements allows greater freedom in design of wider band radiating elements, especially for flat panel antennas, i.e., antennas built on a single or multilayer circuit board. Increased spacing between elements allows room for both vertical and horizontal polarization and wider-band radiating elements. Polarization diversity and wider-band can be very expensive to achieve with tighter spacing between elements. Flat panel antennas are made possible because of the increase in element spacing, for example going from 0.5 wavelength spacing to 1.0 wavelength spacing increases the available circuit board area by at least 300 percent at the center of the array. For elements that are further away from the center, the available circuit board space increases more. The greater circuit board area per element allows a single or multilayer circuit board antenna array, greatly reducing cost versus the conventional technique of stacking modules side-by-side. Cooling may be simple forced air versus liquid due to greater element spacing.

Figure 15:
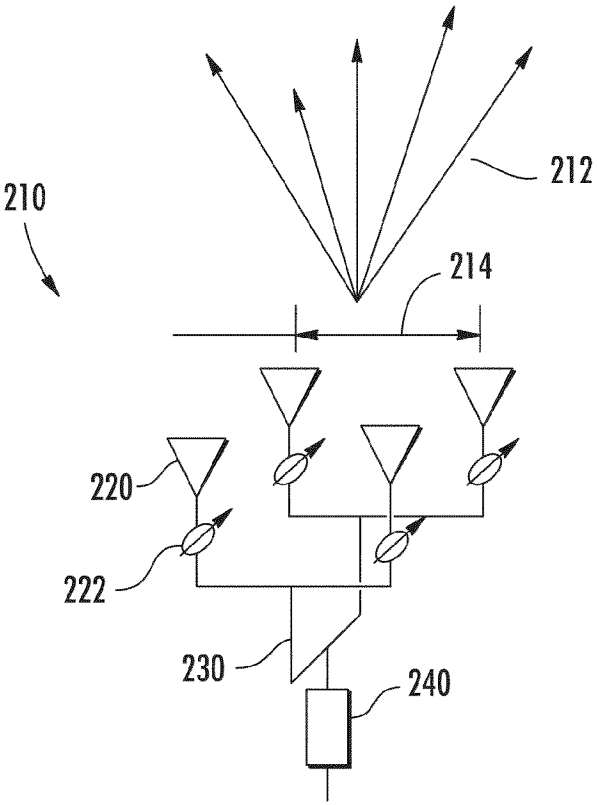

FIG. 15 is a schematic representation of an embodiment of a steering element according to the invention. Steering element 210 may be steered to produce any of a plurality of patterns having directivity 212. Four sub-elements 220 of steering element 210 are shown equally spaced by distance 214. A signal is transmitted by amplifier 240 through lines 230 to phase shifting components 222 which provide a phase-shifted signal to sub-elements 220. The input to amplifier 240 may also be phase-shifted relative to the signals provided to the group of first elements surrounding steering element 210.

Figure 16:
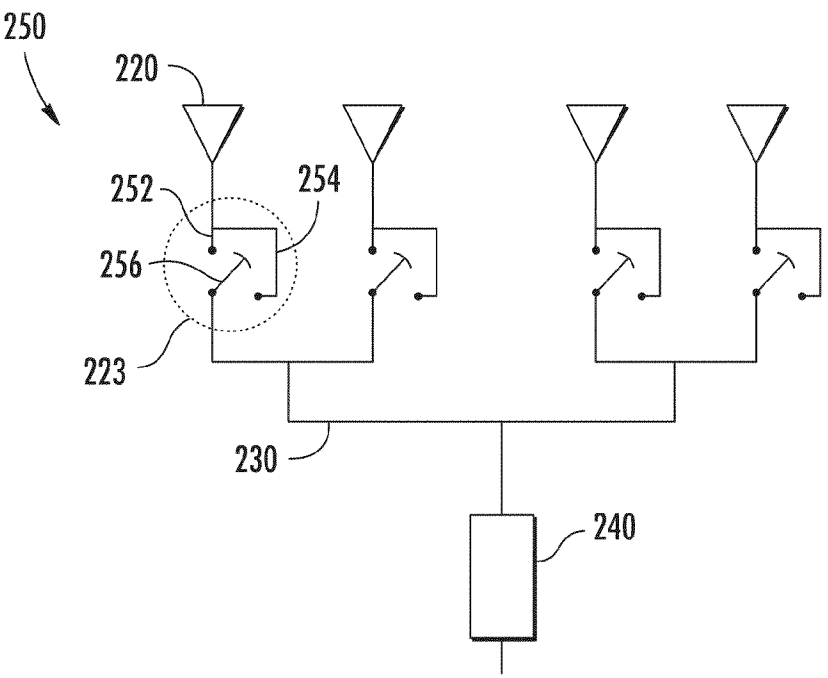
FIGS. 15 and 16 are schematic representations of steering elements according to yet another embodiment of the invention.

Phase shifting component 222 may comprise, for example, two or more signal paths of different lengths to delay signals to sub-element 220. The four signals provided by phase shifting components may be shifted together or individually so that the combined pattern of the four radiating sub-elements 220 is stronger in the direction of the main beam and weaker in the direction of the grating lobe or strong side lobe thereby improving the overall or composite array pattern. Amplifier 240 may weigh the signal it provides to phase shifting components 222 to magnify or deemphasize the contribution of steering element 210 to the composite radiation pattern. FIG. 16 is a schematic representation of another embodiment of a steering element according to the invention. Although shown side-by-side for clarity, four sub-elements 220 are disposed in a square pattern like the pattern shown with reference to FIG. 15 forming steering element 250. Each phase shifting component 223 comprises a switch 256 and connectors 252 and 254 having different lengths and electronically communicating a signal provided by amplifier 240 to sub-elements 220 through either connector 252 or 254. A time delay is introduced by transmitting an incoming signal through switch 256 and connector 254 compared to transmission through switch 256 and connector 252 due to the longer length of connector 254. A multi-pole switch and a plurality of connectors having a plurality of lengths may be provided to introduce a plurality of signal paths of different lengths to delay signals to sub-elements 220. The four signals provided by phase shifting components may be shifted together or individually so that the second pattern generated by sub-elements 220 is stronger in the direction of the main beam and weaker in the direction of the grating lobe or strong side lobe thereby improving the composite array pattern.

Figure 17:
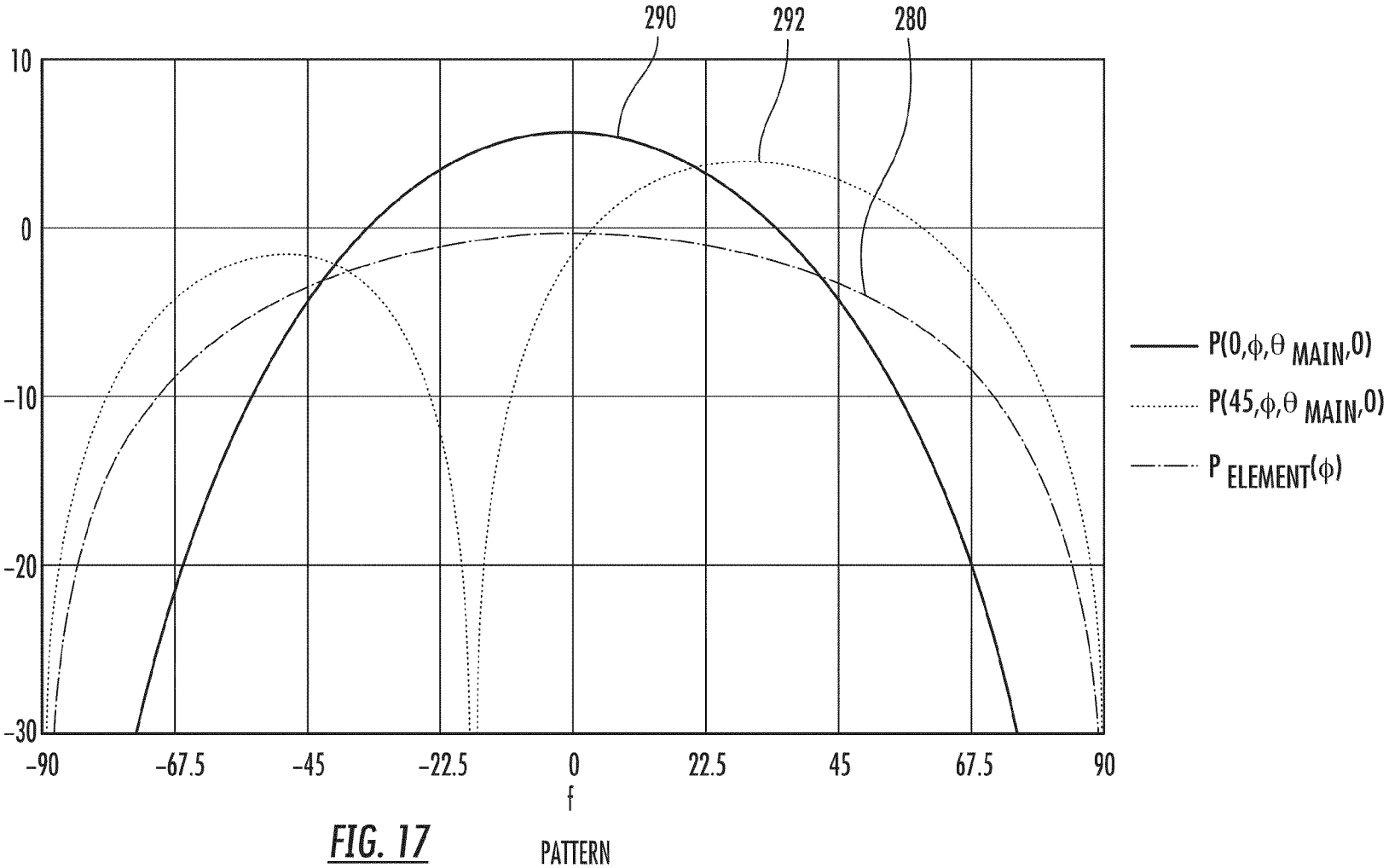
FIG. 17 is a graph illustrating radiation patterns of first and second elements.

FIG. 17 is a graph illustrating radiation patterns of base and steering elements. Pattern 280 results from steering a base element to 0 degrees. Patterns 290 and 292 result from steering a steering element to 0 and 45 degrees, respectively. The steering elements have higher gain than the single base element due to the four radiating sub-elements of the steering element adding together. Advantageously, the modules associated with sub-elements 220, which include components 222 and 223 and may, additionally, include filters and amplifiers, may be of simple construction, e.g., one-bit phase shifters and bipolar switches, which, while having limited steering capability nonetheless add another control lever to reduce the amplitude and directivity of selected side lobes. For example, components 222 and 223 may steer to one of four quadrants rather than to precise angles. Multiple steering elements 210, 250 may be provided which may be steered together to form the second radiation pattern and improved composite pattern.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. An antenna array comprising:

a plurality of first elements operable to radiate or receive electromagnetic energy, said first elements having a first phase range including a plurality of first phases, each of the first elements being spaced apart from a pattern center by an individual element distance and from the nearest first element by an individual element spacing in a regulated pattern, wherein in the regulated pattern each element spacing increases when a respective element distance increases from said pattern center, the plurality of first elements configured to generate a first radiation pattern based partially on the regulated pattern and at least one of said plurality of first phases; and a plurality of second elements positioned within a group of first elements from the plurality of first elements, wherein each said second elements comprises of two or more steering sub-elements, each said steering sub-element is placed within said regulated pattern, positioned within said group, and is operable to radiate or receive electromagnetic energy, said steering sub-element having fewer adjustment increments of said phase range than said electromagnetic energy produced by said first elements, the plurality of second elements configured to generate a second radiation pattern comprising a steerable radiation pattern;

wherein the second radiation pattern combines with the first radiation pattern to form a composite radiation pattern thereby suppressing one or more undesirable side lobes generated from said plurality of first elements.

2. An antenna array as in claim 1, wherein the composite radiation pattern can be generated over a second phase range which is wider than the first phase range.

3. An antenna array as in claim 1, wherein at least one of said steering sub-element has greater frequency range than at least one of the first elements.

4. An antenna array as in claim 3, wherein at least one said second elements includes a plurality of said steering sub-elements that are driven by a common amplifier.

5. An antenna array as in claim 4, further including a plurality of second elements evenly distributed around the pattern center.

6. An antenna array as in claim 1, wherein the composite radiation pattern has a different directivity than the first radiation pattern.

7. An antenna array as in claim 6, wherein the first radiation pattern includes a main lobe and a large side lobe, and directivity of the first radiation pattern is increased by reducing directivity of the large side lobe with the second radiation pattern.

8. An antenna array comprising:

a first plurality of first elements operable to radiate or receive electromagnetic energy over a first phase range, said first plurality of first elements including a plurality of first phases, each of the first elements being spaced apart from a pattern center by an element distance and from the nearest first element by an element spacing in a regulated pattern, wherein in the regulated pattern the element spacing increases when the element distance increases, the first plurality of first elements configured to generate a first radiation pattern based partially on the regulated pattern and the plurality of first phases; and a plurality of second elements intermixed in the regulated pattern with the first plurality of first elements, said plurality of second elements comprises two or more steering elements, each said steering element is placed within said regulated pattern and has structure or components to radiate or receive electromagnetic energy, said plurality of second elements having fewer adjustment increments of said phase range than said electromagnetic energy produced by said first elements, the plurality of second elements forming a steering element commonly driven to generate a second radiation pattern, wherein the second radiation pattern combines with the first radiation pattern to form a composite radiation pattern thereby suppressing one or more undesirable side lobes generated from said plurality of first elements.

9. An antenna array as in claim 8, wherein plurality of second elements forms a plurality of steering elements evenly distributed around the pattern center.

10. An antenna array as in claim 8, wherein the composite radiation pattern has higher directivity than the first radiation pattern.

* * * * *